US005402759A

United States Patent [19]

Ding et al.

[11] Patent Number: 5,402,759

[45] Date of Patent: Apr. 4, 1995

[54] CYLINDER DECOMPRESSION ARRANGEMENT IN CAM SHAFT

[75] Inventors: Xian H. Ding, Shanghai, China; Lam H. Ming, Ysing Yi Island; Chu K. Ying, Yuen Long, both of Hong Kong

[73] Assignee: Outboard Marine Corporation, Waukegan, Ill.

[21] Appl. No.: 272,416

[22] Filed: Jul. 8, 1994

[51] Int. Cl.[6] ..... F01L 13/08

[52] U.S. Cl. ..... 123/182.1; 123/90.17; 123/90.6; 74/568 R

[58] Field of Search ..... 123/90.15, 90.17, 90.18, 123/90.6, 182.1; 74/567, 568 R

[56] References Cited

U.S. PATENT DOCUMENTS

| | | | |
|---|---|---|---|
| B 558,251 | 1/1976 | Harkness | 123/182 |
| 2,323,304 | 7/1943 | Bowman | 123/182 |
| 2,850,002 | 9/1958 | Hovel | 123/182 |
| 3,223,076 | 12/1965 | Isoda | 123/182 |
| 3,314,408 | 4/1967 | Fenton | 123/182 |
| 3,342,169 | 9/1967 | Farny et al. | 123/182 |
| 3,362,390 | 1/1968 | Esty | 123/182.1 |
| 3,381,676 | 5/1968 | Campen | 123/182 |
| 3,395,689 | 8/1968 | Kruse | 123/182.1 |
| 3,399,659 | 9/1968 | Isoda | 123/182 |
| 3,496,922 | 2/1970 | Campen | 123/182 |
| 3,511,219 | 5/1970 | Esty | 123/182 |
| 3,590,796 | 7/1971 | Harkness | 123/182 |
| 3,620,203 | 11/1971 | Harkness | 123/182.1 |
| 3,735,745 | 5/1973 | Hatz | 123/182 |
| 3,897,768 | 8/1975 | Thiel | 123/182 |
| 3,901,199 | 8/1975 | Smith | 123/182.1 |
| 3,981,289 | 9/1976 | Harkness | 123/182 |
| 4,018,203 | 4/1977 | Legros | 123/182.1 |
| 4,165,728 | 8/1979 | Matsumoto et al. | 123/182 |
| 4,184,468 | 1/1980 | Freyn | 123/182 |
| 4,200,079 | 4/1980 | Darlington | 123/179 G |
| 4,312,308 | 1/1982 | Stattery | 123/65 EM |
| 4,394,851 | 7/1983 | Greir et al. | 123/182 |
| 4,453,507 | 6/1984 | Braun et al. | 123/182 |
| 4,455,977 | 6/1984 | Kuczenski | 123/182.1 |
| 4,543,927 | 10/1985 | Luhn et al. | 123/182 |
| 4,610,227 | 9/1986 | Nakano et al. | 123/182.1 |
| 4,615,312 | 10/1986 | Tsumiyama | 123/182 |
| 4,615,313 | 10/1986 | Tsumiyama | 123/182 |
| 4,619,228 | 10/1986 | Liu | 123/182 |
| 4,648,362 | 3/1987 | Kastlunger | 123/182 |
| 4,651,687 | 3/1987 | Yamashita et al. | 123/182 |
| 4,672,930 | 6/1987 | Sumi | 123/182 |
| 4,696,266 | 9/1987 | Harada | 123/182 |
| 4,790,271 | 12/1988 | Onda | 123/182 |
| 4,892,068 | 1/1990 | Coughlin | 123/182 |
| 4,898,133 | 2/1990 | Bader | 123/182 |
| 4,977,868 | 12/1990 | Holschuh | 123/182 |

*Primary Examiner*—Andrew M. Dolinar
*Assistant Examiner*—Weilun Lo
*Attorney, Agent, or Firm*—Michael, Best & Friedrich

[57] ABSTRACT

A cam shaft assembly comprising an elongated shaft including an axis, an end, and an axial bore extending from the end of the shaft and having an end portion adjacent the end of the shaft, a cam located on the shaft and including a cam surface having an eccentric lobe surface and a partially cylindrical surface extending at a uniform radius from the axis, a slot extending axially in the shaft and radially between the axial bore and the cylindrical surface and including a first part in the cam and a second part spaced axially from the first part, an actuating shaft extending in the axial bore, a pin extending radially from the actuating shaft and into the slot for a radial distance greater than the radius of the cylindrical surface, a spring biasing the pin toward the first part of the slot, and a piston subject to fluid pressure, located in the end portion of the axial bore, and engagable with the actuating shaft to axially displace the actuating shaft against the action of the spring so as to locate the pin in the second part of the slot in response to a pressure above a predetermined level.

3 Claims, 1 Drawing Sheet

CYLINDER DECOMPRESSION ARRANGEMENT IN CAM SHAFT

BACKGROUND OF THE INVENTION

The invention relates generally to four stroke internal combustion engines and to arrangements for enabling engine starting by effecting partial decompression of one or more of the engine cylinders.

More particularly, in conventional construction, such engines include a cam shaft which is adapted to be supported by a cylinder head casting or member and to engage an appropriate number of rocker arms so as to control opening and closing of the inlet and outlet valves of a four stroke engine.

Still more particularly, the cam shaft is intended to periodically rotate a rocker arm so as to lift a valve from a normally closed, spring biased, position in seating engagement with an associated valve seat. Consequently, the rocker arm is actuated by the cam shaft when appropriate to displace the valve from the valve seat.

Retaining the exhaust valve in an open position for a longer or extended period of time than when the engine is normally operating will serve to provide at least partial decompression in the associated cylinder, thereby enabling easier starting. Discontinuance of the extended or additional period of time during which the valve is open will permit normal opening and closing of the exhaust valve to obtain normal engine operation.

Attention is directed to the following U.S. Patents.

| U.S. Pat. No. | Inventor(s) | Issue Date |
|---|---|---|
| 2,323,304 | R. H. Bowman | July 6, 1943 |
| 2,850,002 | J. Hovel | September 2, 1958 |
| 3,223,076 | H. Isoda | December 14, 1965 |
| 3,314,408 | A. P. Fenton | April 18, 1967 |
| 3,342,169 | Farny, et al. | September 19, 1967 |
| 3,362,390 | F. B. Esty | January 9, 1968 |
| 3,381,676 | K. W. Campen | May 7, 1968 |
| 3,395,689 | O. A. Kruse | August 6, 1968 |
| 3,399,659 | H. Isoda | September 3, 1968 |
| 3,496,922 | K. W. Campen | February 24, 1970 |
| 3,511,219 | F. B. Esty | May 12, 1970 |
| 3,590,796 | J. R. Harkness | July 6, 1971 |
| 3,620,203 | J. R. Harkness | November 16, 1971 |
| 3,735,745 | E. Hatz | May 29, 1973 |
| 3,897,768 | W. E. Thiel | August 5, 1975 |
| 3,901,199 | A. E. Smith | August 26, 1975 |
| 3,981,289 | J. R. Harkness | September 21, 1976 |
| 4,018,203 | A. Legros | April 19, 1977 |
| 4,165,728 | Matsumoto, et al. | August 28, 1979 |
| 4,184,468 | F. Freyn | January 22, 1980 |
| 4,200,079 | Darlington | April 29, 1980 |
| 4,312,308 | Slattery | January 26, 1982 |
| 4,394,851 | Greier, et al. | July 26, 1983 |
| 4,453,507 | Braun, et al. | June 12, 1984 |
| 4,455,977 | Kuczenski | June 26, 1984 |
| 4,543,927 | Luhn, et al. | October 1, 1985 |
| 4,610,227 | Nakano, et al. | September 9, 1986 |
| 4,615,312 | Tsumiyama | October 7, 1986 |
| 4,615,313 | Tsumiyama | October 7, 1986 |
| 4,619,228 | Liu | October 28, 1986 |
| 4,648,362 | Kastlunger | March 19, 1987 |
| 4,651,687 | Yamashita, et al. | March 24, 1987 |
| 4,672,930 | Sumi | June 16, 1987 |
| 4,696,266 | Harada | September 29, 1987 |
| 4,790,271 | Onda | December 13, 1988 |
| 4,892,068 | Coughlin | January 9, 1990 |
| 4,898,133 | Bader | February 6, 1990 |
| 4,977,868 | Holschuh | December 18, 1990 |

Attention is also directed to U.S. published patent application No. B558,251, filed by J. R. Harkness on Mar. 14, 1975.

SUMMARY OF THE INVENTION

The invention provides a cam shaft assembly comprising an elongated shaft including an axis, an end, and an axial bore extending from the end of the shaft and having an end portion adjacent the end of the shaft, a cam located on the shaft and including a cam surface having an eccentric lobe surface, and a partially cylindrical surface extending at a uniform radius from the axis, a slot extending axially in the shaft and radially between the axial bore and the cylindrical surface and including a first part in the cam and a second part spaced axially from the first part, an actuating shaft extending in the axial bore, a pin extending radially from the actuating shaft and into the slot for a radial distance greater than the radius of the cylindrical surface, and a spring biasing the pin toward the first part of the slot, the actuating shaft having an end located in the end portion of the axial bore and being axially displaceable by fluid pressure above a predetermined level acting in the end portion so as to locate the pin in the second part of the slot against the action of the spring.

The invention also provides a cam shaft assembly comprising an elongated shaft including an axis, an end, an axial bore extending from the end of the shaft and having a counterbore adjacent the end of the shaft, and a blind end axially spaced from the end of the shaft, a shaft portion located between the end of the shaft and the blind end and including an outer surface, a cam located axially adjacent the shaft portion and remotely from the blind end and including a cam surface having an eccentric lobe surface, and a partially cylindrical surface extending at a uniform radius from the axis, and a slot extending axially of the shaft and radially between the axial bore and each of the cylindrical surface and the outer surface of the shaft portion and including a first end part in the cam, and a second end part in the shaft portion, an actuating assembly including an actuating shaft extending in the axial bore and including a first end axially spaced from the blind end, and a second end axially spaced from the first end, and a pin extending radially from the actuating shaft and into the slot for a radial distance greater than the radius of the cylindrical surface, a spring located in the axial bore and engaged between the first end of the actuating shaft and the blind end of the axial bore, and operative to locate the pin in the first part of the slot, and a piston subject to fluid pressure, located in the counterbore, and engagable with the second end of the actuating shaft to axially displace the actuating shaft against the action of the spring so as to locate the pin in the second part of the slot in response to a pressure above a predetermined level.

The invention also provides a cam shaft assembly comprising an elongated shaft including an axis, an end, an axial bore extending from the end and having a counterbore adjacent the end of the shaft, and a blind end axially spaced from the end of the shaft, a first bearing adjacent the shaft end, a second bearing spaced axially from the first bearing, a central bearing spaced axially from and located between the first and second bearings, a first exhaust valve cam on the shaft between the first and central bearings and including a cam surface having an eccentric lobe surface, and a partially cylindrical surface extending at a uniform radius from the axis, a second exhaust valve cam on the shaft between the central and second bearings and including a cam surface having an eccentric lobe surface, and a partially cylindrical surface extending at a uniform radius from the axis, a first shaft portion on the shaft adjacent the first cam and between the first cam and the second cam and including an outer surface, a second shaft portion on the shaft adjacent the second cam and between the second cam and the blind end of the shaft and including an outer surface, a first slot extending radially between the axial bore and each of the cylindrical surface of the first cam and the outer surface of the first shaft portion and including a first end part in the first cam, and a second end part in the first shaft portion, a second slot extending axially in the shaft and radially between the axial bore and each of the cylindrical surface of the second cam and the outer surface of the second shaft portion and including a first end part in the second cam, and a second end part in the second shaft portion, an actuating shaft extending in the axial bore and including a first end axially spaced from the blind end of the shaft, and a second end axially spaced from the first end of the shaft, a first pin extending radially from the actuating shaft and into the first slot for a radial distance greater than the radius of the cylindrical surface of the first cam, a second pin extending radially from the actuating shaft and into the second slot for a radial distance greater than the radius of the cylindrical surface of the second cam, a spring located in the axial bore and engaged between the first end of the actuating shaft and the blind end of the axial bore, and operative to locate the first and second pins in the first parts of the first and second slots, and a piston subject to fluid pressure, located in the counterbore, and engagable with the second end of the actuating shaft to axially displace the actuating shaft against the action of the spring so as to locate the first and second pins in the second parts of the first and second slots in response to a pressure above a predetermined level.

Other features and advantages of the invention will become apparent to those skilled in the art upon review of the following detailed description, claims and drawings.

Figure 1:
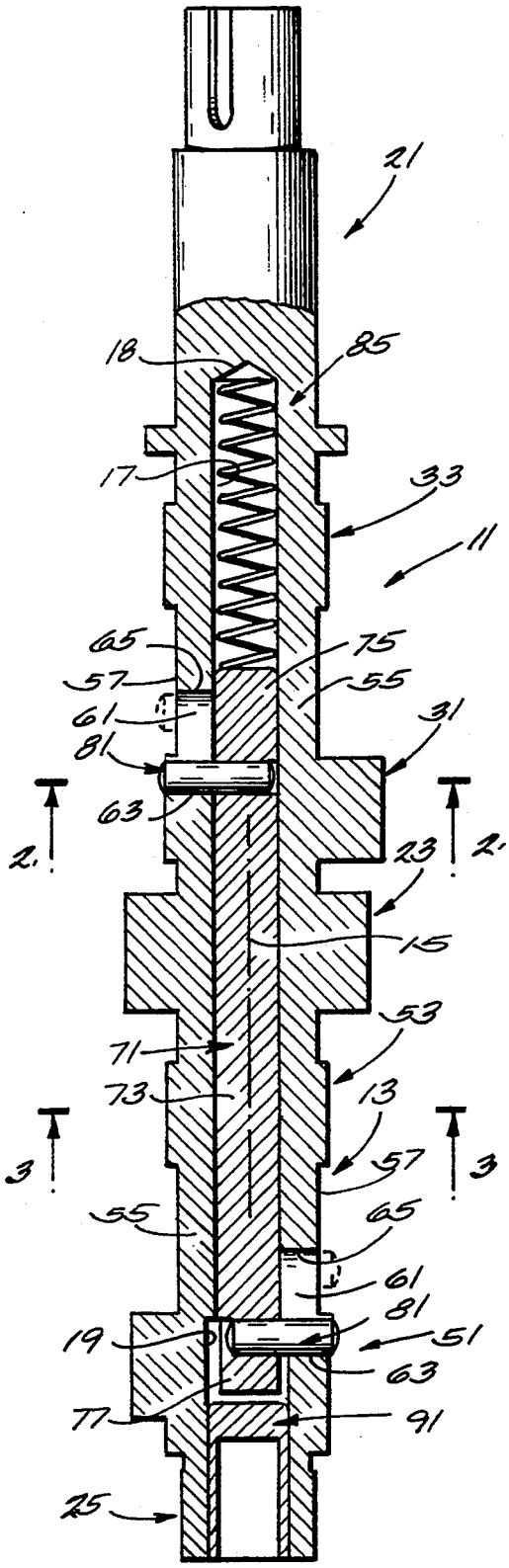
FIGS. 1-3 are cross-sectional views of a camshaft assembly embodying various of the features of the invention.
Figure 2:
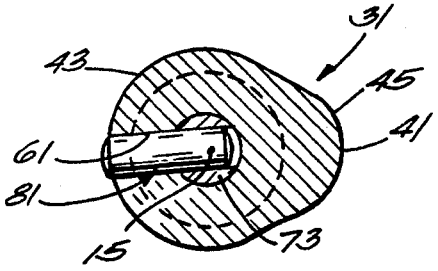
Figure 3:
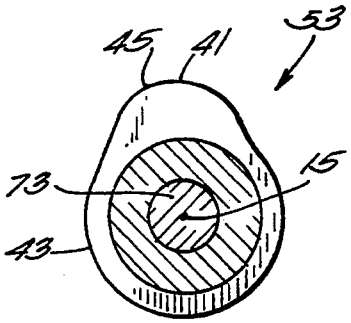

Before one embodiment of the invention is explained in detail, it is to be understood that the invention is not limited in its application to the details of the construction and the arrangements or components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a cam shaft assembly 11 which is adapted to be rotatably supported in a cylinder head casting or member (not shown) and which is adapted to displace a series of rocker arms (not shown) to effect partial decompression of one or more engine cylinders (not shown) during starting (or at idle) and to discontinue such partial decompression upon an increase in engine speed so as to obtain normal engine operation.

The cam shaft assembly 11 shown in the drawings is particularly adapted to be employed with a two cylinder engine (not shown) with each cylinder having one exhaust valve and one inlet valve (not shown). The cam shaft assembly 11 includes an elongated cam shaft 13 having a central axis 15 and an axial bore 17 which, at one end of the cam shaft 13, is open and which, remotely from the open end is closed or blind, as indicated at 18. At its open end, the axial bore 17 includes a counter bore 19 which will be referred to hereinafter.

The cam shaft 13 includes three axially spaced upper, central, and lower bearing areas or journals 21, 23, and 25 affording support and rotation of the cam shaft 13 about the axis.

The cam shaft 13 includes, between and spaced from the upper and middle bearings 21 and 23, one exhaust valve cam portion 31 and one inlet valve cam portion 33. Each of the cam portions 31 and 33 has an axially extent defined between axially spaced side surfaces and a peripheral cam surface 41 including a generally cylindrical surface 43 which extends at a fixed radius from the axis 15 for an angular distance of about 180°. The cam surface 41 also includes a lobe surface 45 which extends from the cylindrical surface 43 at a varying radius greater than the radius of the cylindrical surface 43 and which displaces the engaged rocker arms (not shown) to effect displacement of the valves from their valve seats. In the disclosed construction, the inlet valve cam portion 33 is located adjacent the upper bearing 21 and the exhaust valve cam portion 31 is located adjacent the middle bearing 23. Similar exhaust and inlet valve cam portions 51 and 53 are located between the middle 23 and lower bearings 25 to actuate the inlet and exhaust valves of the lower cylinder.

Located adjacent to each exhaust valve cam portion 31 and 51 on the side thereof remote from the blind end 18 of the axial bore are respective shaft portions 55 having outer surfaces 57.

The cam shaft 13 also includes, with respect to each exhaust valve cam portion 31 and 51 and the adjacent shaft portion 55, an axially extending slot 61 having a first end 63 in one of the exhaust valve cam portions 31 and 51 and a second end 65 in the associated shaft portion 55. The slots 61 extend radially from the axial bore 17 to the cylindrical surface 43 of the associated cam portion 31 and 51 and to the outer surface 57 of the adjacent shaft portion 55.

The cam shaft assembly 11 also includes an actuating shaft assembly 71 including an actuating shaft 73 located in the axial bore 17 and including a first end 75 in axially spaced relation from the blind end 18 of the axial bore 17 and a second end 77 spaced axially from the first end 75 and located in the counter bore 19.

The actuating assembly 71 also includes first and second pins 81 which extend rigidly and perpendicularly from the actuating shaft 73 and respectively into the slots 61. The pins 81 have a greater radial length than the cylindrical surfaces 43 so that when the pins 81 are in the first or cam portion end 63 of the slots 61, the pins 81 protrude beyond the cylindrical surfaces 43 to engage the rocker arms and thereby to prevent seating of the exhaust valves against their valve seats, thereby limiting the compression within the associated cylinders i.e., thereby producing partial decompression.

Means are provided for biasing the pins 81 into the first or cam portion ends 65 of the slots 61. While other specific constructions can be employed, in the disclosed construction, such means comprises a helical spring 85 located in the axial bore 17 and having one end bearing against the first end 75 of the actuating shaft 73 and a second end bearing against the blind end 18 of the axial bore 17. When the pins 81 are in the first or cam portion ends 65 of the slots 61, the pins 81 extend beyond the cylindrical surfaces 43 and are engaged by the associated rocker arms to lengthen the interval during which the exhaust ports are open, thereby providing partial decompression.

Means are also provided for displacing the pins 81 out of the first or cam portion ends 65 of the slots 61 and into the second ends 63 of the slots 61 in the shaft portions 55 in response to engine starting or engine speed above a predetermined low or idle speed. While other arrangements can be employed, in the disclosed construction, such means comprises the before mentioned counter bore 19 and a piston 91 which is located in the counter bore 19, which is subject to oil pressure generated by an oil pump (not shown) driven by the engine at a speed proportional to engine speed (and thereby providing higher oil pressure with higher engine speed), and which is engagable with the second end 77 of the actuating shaft 73 to axially displace the actuating shaft 73 against the action of the spring 85 so as to displace the pins 81 from the first or cam portion ends 75 of the slots 61 and into the second or shaft portion ends 77 of the slots 61, thereby discontinuing the engagement of the pins 81 with the rocker arms and consequently permitting full engagement of the exhaust valves with the valve seats and normal compression during engine operation above a predetermined low or idle speed.

Various of the features of the invention are set forth in the following claims.

We claim:

1. A cam shaft assembly comprising an elongated shaft including an axis, an end, and an axial bore extending from said end of the shaft and having an end portion adjacent said end of the shaft, a cam located on the shaft and including a cam surface having an eccentric lobe surface, and a partially cylindrical surface extending at a uniform radius from said axis, a slot extending axially in said shaft and radially between said axial bore and said cylindrical surface and including a first part in said cam and a second part spaced axially from said first part, an actuating shaft extending in said axial bore, a pin extending radially from said actuating shaft and into said slot for a radial distance greater than said radius of said cylindrical surface, and a spring biasing said pin toward said first part of said slot, said actuating shaft having an end located in said end portion of said axial bore and being axially displaceable by fluid pressure above a predetermined level acting in said end portion so as to locate said pin in said second part of said slot against the action of said spring.

2. A cam shaft assembly comprising an elongated shaft including an axis, an end, an axial bore extending from said end and having a counterbore adjacent said end of said shaft, and a blind end axially spaced from said end of said shaft, a shaft portion located between said end of said shaft and said blind end and including an outer surface, a cam located axially adjacent said shaft portion and remotely from said blind end and including a cam surface having an eccentric lobe surface, and a partially cylindrical surface extending at a uniform radius from said axis, and a slot extending axially of said shaft and radially between said axial bore and each of said cylindrical surface and said outer surface of said shaft portion, and including a first end part in said cam, and a second end part in said shaft portion, an actuating assembly including an actuating shaft extending in said axial bore and including a first end axially spaced from said blind end, and a second end axially spaced from said first end, and a pin extending radially from said actuating shaft and into said slot for a radial distance greater than said radius of said cylindrical surface, a spring located in said axial bore and engaged between said first end of said actuating shaft and said blind end of said axial bore, and operative to locate said pin in said first part of said slot, and a piston subject to fluid pressure, located in said counterbore, and engagable with said second end of said actuating shaft to axially displace said actuating shaft against said action of said spring so as to locate said pin in said second part of said slot in response to a pressure above a predetermined level.

3. A cam shaft assembly comprising an elongated shaft including an axis, an end, an axial bore extending from said end and having a counterbore adjacent said end of said shaft, and a blind end axially spaced from said end of said shaft, a first bearing adjacent said shaft end, a second bearing spaced axially from said first bearing, a central bearing spaced axially from and located between said first and second bearings, a first exhaust valve cam on said shaft between said first and central bearings and including a cam surface having an eccentric lobe surface, and a partially cylindrical surface extending at a uniform radius from said axis, a second exhaust valve cam on said shaft between said central and second bearings and including a cam surface having an eccentric lobe surface, and a partially cylindrical surface extending at a uniform radius from said axis, a first shaft portion on said shaft adjacent said first cam and between said first cam and said second cam and including an outer surface, a second shaft portion on said shaft adjacent said second cam and between said second cam and said blind end of said shaft and including an outer surface, a first slot extending radially between said axial bore and each of said cylindrical surface of said first cam and said outer surface of said first shaft portion and including a first end part in said first cam, and a second end part in said first shaft portion, a second slot extending axially in said shaft and radially between said axial bore and each of said cylindrical surface of said second cam and said outer surface of said second shaft portion and including a first end part in said second cam, and a second end part in said second shaft portion, an actuating shaft extending in said axial bore and including a first end axially spaced from said blind end of said shaft, and a second end axially spaced from said first end of said shaft, a first pin extending radially from said actuating shaft and into said first slot for a radial distance greater than said radius of said cylindrical surface of said first cam, a second pin extending radially from said actuating shaft and into said second slot for a radial distance greater than said radius of said cylindrical surface of said second cam, a spring located in said axial bore and engaged between said first end of said actuating shaft and said blind end of said axial bore, and operative to locate said first and second pins in said first parts of said first and second slots, and a piston subject to fluid pressure, located in said counterbore, and engagable with said second end of said actuating shaft to axially displace said actuating shaft against said action of said spring so as to locate said first and second pins in said second parts of said first and second slots in response to a pressure above a predetermined level.

* * * * *